US009193514B2

(12) United States Patent
Rubino et al.

(10) Patent No.: US 9,193,514 B2
(45) Date of Patent: Nov. 24, 2015

(54) PRODUCT PACKAGING SYSTEM WITH ANTIMICROBIAL AGENT

(75) Inventors: Maria Rubino, East Lansing, MI (US); Siriyupa Netramai, Bangkok (TH); Rafael Auras, Okemos, MI (US); Bassam A. Annous, North Wales, PA (US)

(73) Assignee: BOARD OF TRUSTEES OF MICHIGAN STATE UNIVERSITY, East Lansing, MI (US)

( * ) Notice: Subject to any disclaimer, the term of this patent is extended or adjusted under 35 U.S.C. 154(b) by 0 days.

(21) Appl. No.: 14/233,314

(22) PCT Filed: Jul. 18, 2012

(86) PCT No.: PCT/US2012/047199
§ 371 (c)(1),
(2), (4) Date: Apr. 29, 2014

(87) PCT Pub. No.: WO2013/012923
PCT Pub. Date: Jan. 24, 2013

(65) Prior Publication Data

US 2014/0231283 A1 Aug. 21, 2014

Related U.S. Application Data

(60) Provisional application No. 61/509,034, filed on Jul. 18, 2011.

(51) Int. Cl.

| | |
|---|---|
| ***B65D 81/24*** | (2006.01) |
| ***B65D 81/34*** | (2006.01) |
| ***B65D 81/20*** | (2006.01) |

(52) U.S. Cl.
CPC ..... *B65D 81/34* (2013.01); *B65D 81/2076* (2013.01); *B65D 81/2084* (2013.01)

(58) Field of Classification Search
CPC ..... B65D 33/2591; B65D 81/24
USPC ..... 206/438, 439, 213.1; 383/38, 39, 40
See application file for complete search history.

(56) References Cited

U.S. PATENT DOCUMENTS 2,707,352 A 5/1955 Fischer
3,073,507 A * 1/1963 Trewella et al. ..... 206/439

(Continued)

OTHER PUBLICATIONS

International Search Report and Written Opinion (PCT/US2012/047199)—Date of Mailing Oct. 16, 2012.

(Continued)

*Primary Examiner* — Steven A. Reynolds
*Assistant Examiner* — King M Chu
(74) *Attorney, Agent, or Firm* — Howard & Howard Attorneys PLLC

(57) ABSTRACT

A package providing a storage space with features capable of affecting atmospheric conditions therein, comprising a body having a first and at least one second storage space adjacent thereto, wherein the first storage space is defined by sidewalls, and the at least one second storage space is defined by sidewalls including at least a portion thereof which further defines the first storage space, the second storage space providing a reservoir for containing an antimicrobial agent therein, wherein the antimicrobial agent includes a precursor to chlorine dioxide gas and the portion of the sidewall which further defines the first storage space is configured to allow for the delivery of the chlorine dioxide gas from the second storage space into the first storage space.

14 Claims, 9 Drawing Sheets

(56) References Cited

U.S. PATENT DOCUMENTS

| | | | | |
|---|---|---|---|---|
| 3,229,813 | A * | 1/1966 | Crowe, Jr. et al. | 206/439 |
| 3,403,776 | A * | 10/1968 | Denny | 206/363 |
| 3,923,154 | A * | 12/1975 | Tulis et al. | 206/210 |
| 5,730,530 | A * | 3/1998 | Stoddard et al. | 383/113 |
| 5,947,288 | A * | 9/1999 | Dykstra et al. | 206/439 |
| 6,059,112 | A * | 5/2000 | Dykstra et al. | 206/438 |
| 6,119,855 | A * | 9/2000 | Yeager et al. | 206/213.1 |
| 6,305,148 | B1 | 10/2001 | Bowden et al. | |
| 6,520,323 | B1 * | 2/2003 | Colombo | 206/213.1 |
| 6,530,471 | B1 * | 3/2003 | Tsuyuguchi | 206/204 |
| 7,387,205 | B1 * | 6/2008 | Wilson | 206/524.4 |
| 2004/0131736 | A1 | 7/2004 | Pan et al. | |
| 2006/0186010 | A1 * | 8/2006 | Warnack et al. | 206/438 |
| 2008/0089807 | A1 * | 4/2008 | Lee et al. | 422/37 |
| 2011/0155618 | A1 | 6/2011 | Rubino et al. | |

OTHER PUBLICATIONS

International Preliminary Report on Patentability (PCT/US2012/047199)—Date of Issuance Jan. 21, 2014.

* cited by examiner

Table 1

*Randomized* complete block design information for study 1.

| Class | Level | Value |
|---|---|---|
| Block | 2 | - |
| Replicate | 3 | - |
| Bag design | 2 | 1-GR and 2-GR |
| Concentration | 2 | 4 and 8 mg $ClO_2$ per kg lettuce per day |
| Storage time | 3 | 1, 4, and 7 d |

FIG. 5

Table 2

Effect of bag design and $ClO_2$ gas level (4 or 8 mg/d) treatments on *E. coli* O157:H7 populations inoculated on cut lettuce and stored at 4 °C.

| Treatment (bag design/$ClO_2$ level) | Time (d) | Population[a] ($log_{10}$ CFU/g) | Reduction[b] ($log_{10}$ CFU/g) |
|---|---|---|---|
| Control | 1 | $8.15 \pm 0.08^{a}$ | - |
| | 4 | $8.48 \pm 0.17^{b}$ | - |
| | 7 | $8.71 \pm 0.07^{b}$ | - |
| 1-GR/8 mg | 1 | $7.62 \pm 0.04$ | $0.54 \pm 0.03^{A,a}$ |
| | 4 | $7.60 \pm 0.05$ | $0.82 \pm 0.03^{A,b}$ |
| | 7 | $7.95 \pm 0.05$ | $0.76 \pm 0.06^{A,b}$ |
| 1-GR/4 mg | 1 | $7.73 \pm 0.04$ | $0.42 \pm 0.04^{B,a}$ |
| | 4 | $7.82 \pm 0.03$ | $0.60 \pm 0.04^{B,b}$ |
| | 7 | $8.01 \pm 0.04$ | $0.70 \pm 0.01^{A,c}$ |
| 2-GR/8 mg | 1 | $7.55 \pm 0.04$ | $0.60 \pm 0.02^{C,a}$ |
| | 4 | $7.54 \pm 0.04$ | $0.86 \pm 0.05^{A,b}$ |
| | 7 | $7.74 \pm 0.04$ | $0.97 \pm 0.06^{B,c}$ |
| 2-GR/4 mg | 1 | $7.61 \pm 0.03$ | $0.55 \pm 0.02^{A,a}$ |
| | 4 | $7.54 \pm 0.05$ | $0.87 \pm 0.07^{A,b}$ |
| | 7 | $7.78 \pm 0.02$ | $0.93 \pm 0.03^{B,b}$ |

[a] Mean ± standard deviation; means with different superscript letters are significantly different ($p < 0.05$); b = 2; $n = 3$.

[b] Within the same storage time, different uppercase letters indicate significant differences ($p < 0.05$) between mean reductions for samples from different treatments (bag designs and/or $ClO_2$ levels); within each treatment, different lowercase letters indicate significant differences ($p < 0.05$) between mean reductions at different storage times.

FIG. 6

Table 3

Effect of sampling location on *E. coli* O157:H7 populations inoculated on cut lettuce packed in 1-GR and 2-GR $ClO_2$/d and stored at 4 °C.

| Treatment (bag design/ $ClO_2$ level | Time (d) | *E. coli* O157:H7 ($log_{10}$CFU/g) | | | | |
|---|---|---|---|---|---|---|
| | | Location 1 | | Location 2 | | Location 3 |
| | | Population[a] | Reduction[b] | Population | Reduction | Population |
| 1-GR/8 mg | 1 | 6.99 ± 0.04 | 1.16 ± 0.04$^{A,a}$ | 7.92 ± 0.05 | 0.24 ± 0.04$^{A,b}$ | 7.95 ± 0.07 |
| | 4 | 6.93 ± 0.06 | 1.14 ± 0.05$^{A,a}$ | 7.93 ± 0.08 | 0.48 ± 0.08$^{A,b}$ | 7.94 ± 0.03 |
| | 7 | 7.25 ± 0.12 | 1.46 ± 0.12$^{A,a}$ | 8.30 ± 0.03 | 0.41 ± 0.03$^{A,b}$ | 8.31 ± 0.04 |
| 1-GR/4 mg | 1 | 7.24 ± 0.07 | 0.92 ± 0.07$^{B,a}$ | 7.95 ± 0.03 | 0.20 ± 0.02$^{A,b}$ | 8.01 ± 0.04 |
| | 4 | 7.27 ± 0.03 | 1.14 ± 0.02$^{B,a}$ | 8.08 ± 0.06 | 0.33 ± 0.06$^{B,b}$ | 8.11 ± 0.04 |
| | 7 | 7.50 ± 0.10 | 1.22 ± 0.10$^{B,a}$ | 8.25 ± 0.02 | 0.46 ± 0.02$^{B,b}$ | 8.28 ± 0.03 |
| 2-GR/8 mg | 1 | 7.30 ± 0.06 | 0.85 ± 0.05$^{B,a}$ | 8.04 ± 0.05 | 0.11 ± 0.04$^{B,b}$ | |
| | 4 | 7.30 ± 0.08 | 1.11 ± 0.08$^{B,a}$ | 8.01 ± 0.04 | 0.39 ± 0.04$^{B,b}$ | |
| | 7 | 7.46 ± 0.05 | 1.25 ± 0.05$^{B,a}$ | 8.28 ± 0.03 | 0.43 ± 0.03$^{A,b}$ | |
| 2-GR/4 mg | 1 | 7.39 ± 0.03 | 0.76 ± 0.03$^{C,a}$ | 8.02 ± 0.04 | 0.13 ± 0.03$^{B,b}$ | |
| | 4 | 7.31 ± 0.07 | 1.10 ± 0.06$^{B,a}$ | 8.06 ± 0.10 | 0.34 ± 0.09$^{B,b}$ | |
| | 7 | 7.52 ± 0.05 | 1.19 ± 0.05$^{B,a}$ | 8.31 ± 0.05 | 0.40 ± 0.05$^{A,b}$ | |

[a] Mean ± standard deviation; b = 2; $n = 3$.

[b] Within columns at the same storage time and location, different uppercase letters indicate significant differences ($p < 0.05$) between mean reductions for samples from different treatment (bag or package designs and $ClO_2$ levels); within rows at each treatment, different lowercase letters indicate significant differences ($p < 0.05$) between mean reductions for samples from different locations within the same bag.

FIG. 7

*Table 4*

Effect of $ClO_2$ gas level on *E. coli* O157:H7 populations inoculated on cut lettuce packed in mid-GR bags and stored at 4 °C.

| $ClO_2$ level | Time (d) | Population[a] ($log_{10}$ CFU/g) | Reduction[b] ($log_{10}$ CFU/g) |
|---|---|---|---|
| | 1 | $8.16 \pm 0.04^{a}$ | - |
| Control | 4 | $8.42 \pm 0.05^{b}$ | - |
| | 7 | $8.70 \pm 0.01^{c}$ | - |
| | 1 | $6.93 \pm 0.01$ | $1.21 \pm 0.11^{A,a}$ |
| 8 mg/d | 4 | $7.19 \pm 0.02$ | $1.23 \pm 0.02^{A,a}$ |
| | 7 | $7.47 \pm 0.11$ | $1.24 \pm 0.11^{A,a}$ |
| | 1 | $7.63 \pm 0.05$ | $0.52 \pm 0.05^{B,a}$ |
| 4 mg/d | 4 | $7.36 \pm 0.08$ | $1.06 \pm 0.08^{B,b}$ |
| | 7 | $7.76 \pm 0.17$ | $0.94 \pm 0.17^{B,b}$ |

[a] Mean ± standard deviation; means with different superscript letters are significantly different ($p > 0.05$); b = 2; $n = 3$.

[b] Within storage time, different uppercase letters indicate significant differences ($p < 0.05$) between mean reductions for samples at different $ClO_2$ levels; within each gas level, different lowercase letters indicate significant differences ($p < 0.05$) between mean reductions for samples at different storage times.

FIG. 8

Table 5

Effect of sampling location on *E. coli* O157:H7 populations inoculated on cut lettuce packed in mid-GR bags with 4 or 8 mg $ClO_2$·d and stored at 4 °C.

| $ClO_2$ level | Time (d) | *E. coli* O157:H7 ($log_{10}$ CFU/g) | | | |
|---|---|---|---|---|---|
| | | Location 1 | | Location 2 | |
| | | Population[a] | Reduction | Population | Reduction |
| 8 mg $ClO_2$/kg lettuce·d | 1 | $6.37 \pm 0.06^{A,a}$ | $1.76 \pm 0.06$ | $7.48 \pm 0.19^{A,b}$ | $0.66 \pm 0.19$ |
| | 4 | $6.55 \pm 0.03^{A,a}$ | $1.87 \pm 0.04$ | $7.83 \pm 0.01^{A,b}$ | $0.59 \pm 0.01$ |
| | 7 | $6.58 \pm 0.22^{A,a}$ | $2.13 \pm 0.22$ | $8.36 \pm 0.05^{A,b}$ | $0.34 \pm 0.05$ |
| 4 mg $ClO_2$/kg lettuce·d | 1 | $7.54 \pm 0.10^{B,a}$ | $0.61 \pm 0.10$ | $7.72 \pm 0.02^{B,b}$ | $0.43 \pm 0.02$ |
| | 4 | $6.92 \pm 0.07^{B,a}$ | $1.51 \pm 0.07$ | $7.81 \pm 0.13^{A,b}$ | $0.61 \pm 0.13$ |
| | 7 | $7.07 \pm 0.29^{B,a}$ | $1.63 \pm 0.29$ | $8.45 \pm 0.10^{A,b}$ | $0.26 \pm 0.10$ |

[a] Mean ± standard deviation; within columns at the same storage time and location, different uppercase letters indicate significant differences ($p < 0.05$) between means for samples from different treatments (bag designs and $ClO_2$ levels); within rows at each treatment and time, different lowercase letters indicate significant differences ($p < 0.05$) between means for samples from different locations within the same bag; b = 2; $n = 3$.

FIG. 9

PRODUCT PACKAGING SYSTEM WITH ANTIMICROBIAL AGENT

CROSS-REFERENCE TO RELATED APPLICATION

The instant application claims priority to U.S. Provisional Patent Application Ser. No. 61/509,034 filed Jul. 18, 2011, the entire disclosure of which is expressly incorporated herein by reference.

STATEMENT REGARDING FEDERALLY SPONSORED RESEARCH OR DEVELOPMENT

The invention was made with government support under 2008-51110-04352 awarded by the U.S. Department of Agriculture. The government has certain rights in the invention.

BACKGROUND OF THE INVENTION

1. Field of the Invention

The present invention is directed to packaging, and more particularly, to packages and packaging systems used for shipping items, such as food products, that include one or more features for reducing harmful microbial contaminants which may be associated therewith.

2. Background of the Related Art

The following description of the background and embodiments of the invention thereafter is provided to aid in understanding the invention, but is not admitted to describe or constitute prior art to the invention. The contents of the articles, patents, and patent applications, and all other documents and electronically available information mentioned or cited in this application, are hereby incorporated by reference in their entirety to the same extent as if each individual publication was specifically and individually indicated to be incorporated by reference, including any references cited in the articles, patents, patent applications and documents cited herein. Applicants reserve the right to physically incorporate into this application any and all materials and information from any such articles, patents, patent applications, or other documents.

Disposable containers for packaging, shipping, displaying or otherwise housing perishable products are of significant economic importance. Many such packaging products have been developed with features that significantly improve or extend the life span of perishable products during shipping. These packages advantageously provide substantial savings to companies involved in the production and sale of perishable items in the marketplace.

While many packaging products include features for creating a "modified atmosphere" intended to extend the lifespan of a perishable product, these packaging products lack features which address potentially harmful contamination associated with the perishable products.

SUMMARY OF THE INVENTION

The invention is generally directed to methods and systems for product packaging having one or more features which facilitate the health and safety of products contained therein. In some embodiments, methods and systems of the invention are directed to packaging for food products which include one or more features that facilitate the health and safety of products contained therein by reducing or eliminating causes of foodborne illnesses.

A packaging system constructed in accordance with an exemplary embodiment of the invention provides a storage space and includes a feature for releasing an agent into the storage space, wherein the agent is configured to, or otherwise capable of, affecting food products therein in a manner which facilitates the elimination or retardation of the spread of diseases, pathogenic bacteria, viruses, toxins or parasites of the type which may exist on food products or result from the consumption of contaminated food.

The agent may therefore be an oxidizing agent, a disinfectant possessing antifungal properties, antibacterial (bacteriostatic or bactericidal) properties, insecticidal properties, and/or antimicrobial properties. Examples of agents include, but are not limited to, chlorine dioxide, silver nitrate, thiobendazole, zinc acetate, chlorpyrifos, and others, or combinations thereof, in any form, gaseous, liquid or solid. For convenience and ease in description, the agent having one or more of such properties is hereinafter referred to as an "antimicrobial agent."

In some embodiments, the invention is directed to a package which includes a sealable storage space. The package and/or walls of the storage space may be fabricated of any suitable material. For example, the storage space may be constructed, either wholly or in part, by a plastic or polymer material such as polyethylene. The storage space walls may be substantially permeable, non-permeable or semi-permeable.

The package further includes a body containing an antimicrobial agent in an agent reservoir. The body or agent reservoir is constructed to release the antimicrobial agent into the storage space, either as a result of its properties or physical construction, or a combination thereof. For example, one or more body walls may be perforated, or constructed of a permeable or semi-permeable material or membrane, or a combination thereof, which ultimately provides for the desired release of the agent into the storage space. The body walls may include multiple locations from which agent is released.

The body may be rigid or flexible or include portions which are rigid and portions which are flexible. The body may further include multiple layers of material and one or more chambers with one or more antimicrobial agents contained therein.

In some embodiments, the antimicrobial releasing body is fabricated as a reservoir associated with the package. For example, the package may include a seam in which the body may be incorporated. The body may be configured with the package in other natural-appearing configurations, such as within a side wall of the package itself.

In some embodiments, the antimicrobial agent releasing body may be inserted into an existing package. The outer wall of the body may contain an adhesive which facilitates being adhered to an interior wall of the storage space of a package.

In some embodiments, the body construction is used to affect the rate of release of the agent into the storage space. The body construction or agent may differ depending on the desired rate of release of the agent and/or the food product contained in the package.

In some embodiments, the body includes a releasing tab 22 which may be adhered to the body in a position covering a permeable or semi-permeable wall. The tab can be removed upon sealing the package to effectuate the release of the agent.

In some embodiments, the body may include one or more releasing tabs 22 which can be selectively removed upon sealing the package depending on the food product contained therein.

It is envisioned that the invention may be used with any product in which it would advantageous to reduce harmful microbial contaminants, such as surgical equipment, tools, sensitive materials, medicines, and food products including, but not limited to, fruits (e.g., cut and/or whole fruit), vegetables (e.g., cut and/or whole vegetables), meats and/or seafood, or any other non-comestible product which may harbor harmful contaminants, such as flowers or plants.

A packaging system of the invention may be incorporated with other atmospheric modifiers, such as modifiers which improve the lifespan of a product or a desiccant.

Some embodiments are directed to a package providing a storage space with features capable of affecting atmospheric conditions therein, comprising a body having a first and at least one second storage space adjacent thereto, wherein the first storage space is defined by sidewalls, and the at least one second storage space is defined by sidewalls including at least a portion thereof which further defines the first storage space, the second storage space providing a reservoir for containing an antimicrobial agent therein, wherein the antimicrobial agent includes a precursor to chlorine dioxide gas and the portion of the sidewall which further defines the first storage space is configured to allow for the delivery of the chlorine dioxide gas from the second storage space into the first storage space.

The aforementioned package may be configured so that the at least one second storage space is positioned at a first end of the package body or alternatively in the middle area. There may be multiple second storage spaces, such as two defined at opposing or substantially distal ends of the package body. The second storage space may be substantially tubular in shape.

In some embodiments, the portion of the sidewall which further defines the first storage space is constructed of a material which is permeable to chlorine dioxide gas. In other embodiments, the portion of the sidewall may be perforated.

In some embodiments, the chlorine dioxide gas precursor is configured to deliver chlorine dioxide gas in dosage which is less than 10 milligrams per day.

The invention is also directed to a package providing a storage space with features capable of affecting atmospheric conditions therein, comprising a body divided into a first and at least one second storage space adjacent thereto, wherein the first storage space is defined by sidewalls, and the at least one second storage space includes a shared sidewall with the first storage space, the second storage space providing a reservoir for containing an antimicrobial agent therein, wherein the antimicrobial agent includes a precursor to chlorine dioxide gas and the shared portion of the sidewall is configured to allow for the delivery of the chlorine dioxide gas from the second storage space into the first storage space.

In some embodiments, the aforementioned package is configured such that the chlorine dioxide gas precursor is configured to deliver chlorine dioxide gas in dosage which is less than 10 milligrams per day from at least two distally positioned second storage spaces.

These and other aspects of the system of the invention will become more readily apparent to those having ordinary skill in the art from the following detailed description of the invention taken in conjunction with the drawings.

BRIEF DESCRIPTION OF THE FIGURES

So that those having ordinary skill in the art to which the invention pertains will more readily understand how to make and use the invention, embodiments thereof will be described in detail below with reference to the drawings, wherein:

FIG. 5 provides Table 1 containing data relating to a randomized complete block design information for study 1;

FIG. 6 provides Table 2 containing data relating to the effect of package design and $ClO_2$ gas level treatments on *Escherichia coli* O157:H7 populations on cut lettuce, among other things;

FIG. 7 provides Table 3 containing data relating to the effect of sampling location on *E. coli* O157:H7 populations in packages of some embodiments of the invention, among other things;

FIG. 8 provides Table 4 containing data relating to the effect of chlorine dioxide gas ($ClO_2$) level on *E. coli* O157:H7 populations in packages of some embodiments of the invention, among other things; and FIG. 9 provides Table 5 containing data relating to the effect of sampling location on *E. coli* O157:H7 populations in packages of some embodiments of the invention, among other things.

DETAILED DESCRIPTION OF THE INVENTION

Figure 1:
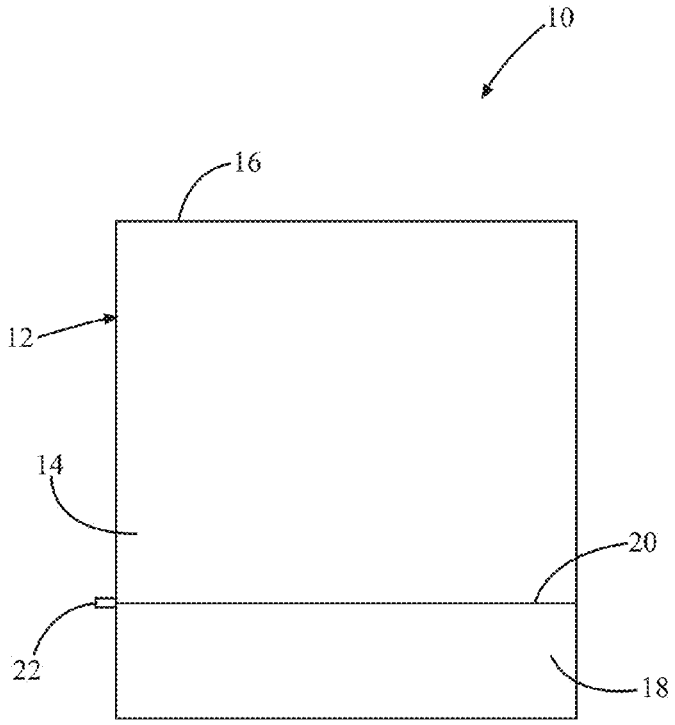
FIG. 1 is a schematic view of an embodiment of a package design constructed in accordance with some embodiments of the invention.

Reference is now made to FIG. 1, wherein there is illustrated a package in accordance with some embodiments of the invention referred to herein and generally designated by the reference numeral 10.

Package 10 generally includes a body 12 having a modified atmosphere storage space 14 with a closable opening 16 allowing for re-sealable and/or non-re-sealable entry thereto, and an antimicrobial agent reservoir ("GR") 18 separated from modified atmosphere storage space by a wall 20. Body 12 may be any size or shape, and constructed of a firm or flexible material, as may be desired for the contents to be contained in modified atmosphere storage space 14. One or more antimicrobial agents are stored in GR 18. Wall 20 is configured to allow for the migration of the antimicrobial agent from GR 18 into modified atmosphere storage space 14.

In some embodiments, wall 20 is constructed of a material which is permeable, thus allowing for migration of antimicrobial agent into modified atmosphere storage space 14. In other embodiments, wall 20 is perforated or passageways between GR 18 and modified atmosphere storage space 14 are provided to allow for the migration of antimicrobial agent from GR 18 to modified atmosphere storage space 14.

In some embodiments, package 10 is further configured to include a feature which inhibits migration of the antimicrobial agent from GR 18 to modified atmosphere storage space 14. This feature may be a mechanical feature, such as a removable cover constructed of a material which inhibits migration of the antimicrobial agent which is disposed over all or a portion of wall 20 or passageways therethrough. In such embodiments, the removable cover may be removed prior to filling modified atmosphere storage space 14 and closing opening 16.

In some embodiments, the antimicrobial agent is selected based on properties which allow for the gradual or time-released migration thereof into modified atmosphere storage space 14. For example, the migration of antimicrobial agent may require the occurrence of one or more reactions or phase changes prior to migration occurring. The antimicrobial agent may be in a precursor form or provided as an intermediate which will form the agent thereafter. Alternatively, the microbial agent may be encapsulated or otherwise controlled by a time-release substance or mechanism. The antimicrobial agent may also be selected based on properties which inhibit migration when package 10 is not in use. For example, the antimicrobial agent may be of a type or in a form which is relatively dormant or otherwise does not migrate during certain storage conditions, such as when package 10 is stored in a lowered temperature environment.

In some embodiments, GR 18 is prefilled with antimicrobial agent, whereas in some embodiments GR 18 is further configured to be filled with antimicrobial agent after package 10 is formed, which may include a receiving port with a closure, such as a twist off cap or patch with adhesive material.

Figure 2:
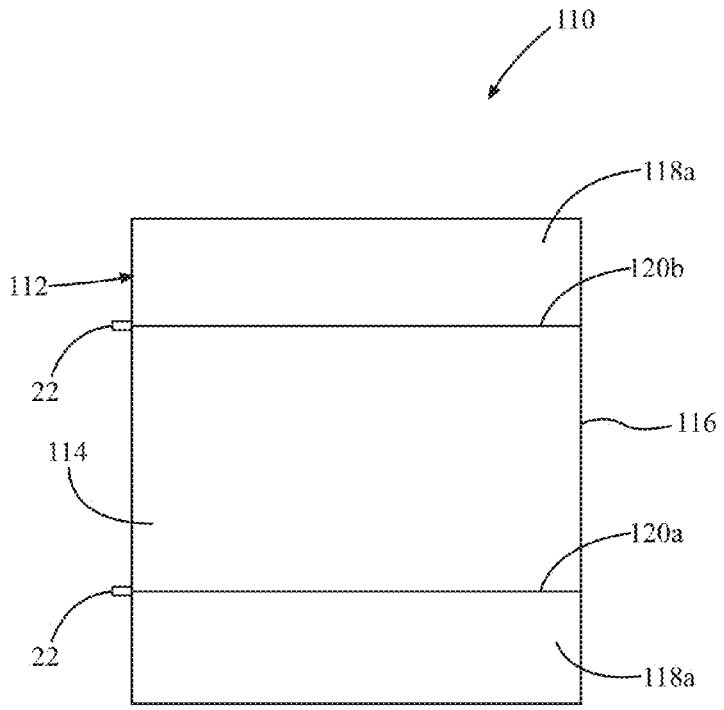
FIG. 2 is a schematic view of another embodiment of a package design constructed in accordance with some embodiments of the invention.

FIG. 2 illustrates a package 110 constructed in accordance with another embodiment of the invention in which there are multiple antimicrobial agent reservoirs 118*a* and 118*b* separated from modified atmosphere storage space 114 by corresponding walls 120*a* and 120*b*. It should be understood that the various alternatives and embodiments as discussed above with regard to package 10 and wall 20 and GR 18 may be similarly employed with respect to package 110, and in connection with one or both GRs 118*a,b* and/or walls 120*a, b*.

Figure 3:
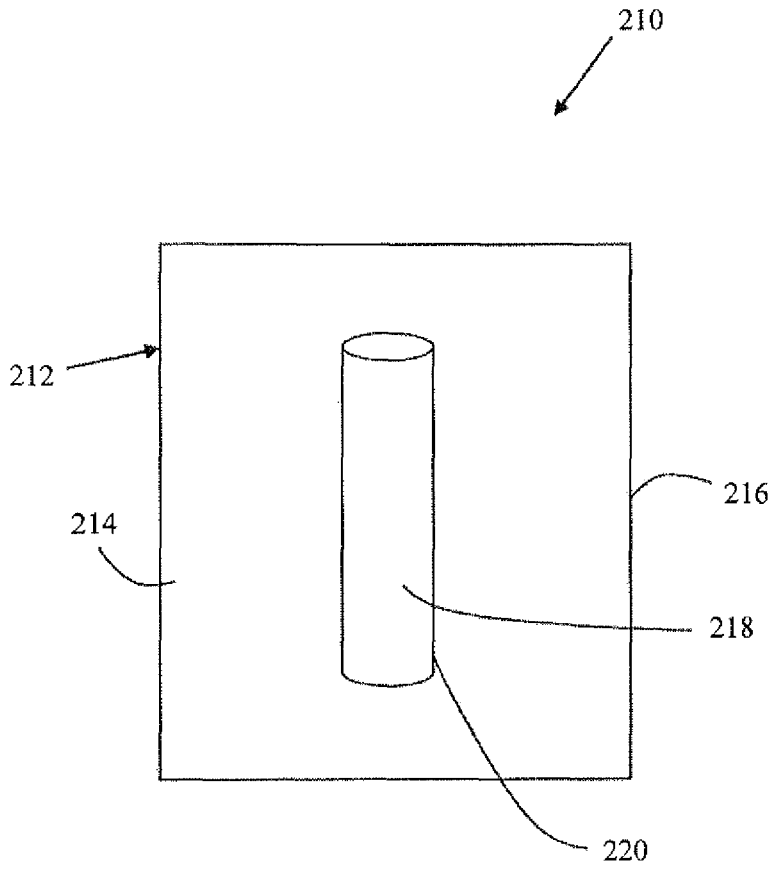
FIG. 3 is a schematic view of yet another embodiment of a package design constructed in accordance with some embodiments of the invention.

FIG. 3 illustrates a package 210 constructed in accordance with another embodiment of the invention which includes an antimicrobial agent reservoir tube 218 thus defining a peripheral wall 220 allowing for the migration of antimicrobial agent into modified atmosphere storage space 214. GR 218 is shown in a substantially central location of modified atmosphere storage space 214, but may be located elsewhere. Multiple reservoir tubes such as tube 218 may be employed as well as the various alternatives discussed above with respect to package 10 and reservoir 16 may also be employed with respect to package 210, reservoir tube 218 and wall 220.

The following detailed description provides exemplary non-limiting embodiments of the invention in which $ClO_2$ was employed as the antimicrobial agent in packaging containing fresh-cut lettuce and tests were conducted. It should be readily apparent that other agents may be used in connection with the same or other products in accordance with other embodiments of the invention.

Studies

Introduction

Embodiments of the invention as shown in FIGS. 1, 2 and 3 were used in these studies as described herein. $ClO_2$ gas was generated in the GR at either 4 or 8 mg $ClO_2$ per kg lettuce per day. *Escherichia coli* O157:H7-artificially inoculated fresh-cut lettuce was packed in the bags and stored at 4° C. for up to seven days. Increasing the $ClO_2$ gas dose resulted in greater $\log_{10}$ CFU/g reductions of *E. coli* O157:H7 for the package 10 and package 210 designs. For the package 110 design, the same degree of antimicrobial effect could be achieved with the lower $ClO_2$ dose. Significantly greater ($p<0.05$) $\log_{in}$ CFU/g reductions of *E. coli* O157:H7 were observed in lettuce samples taken from locations adjacent to the reservoirs.

Materials and Methods

Flexible polyolefin packages were formed as shown in FIGS. 1, 2 and 3 (i.e., packages 10, 110 and 210) and employed herein. The antimicrobial agents consisted of $ClO_2$ gas precursors (Special Mix with linear release) which were obtained from ICA TriNova LLC (Newnan, Ga.). Two types of precursor were used in the study to provide different levels of $ClO_2$ gas release: the fast-release type released 8 mg $ClO_2$ per kg lettuce per day (high level) and the slow-release type released 4 mg $ClO_2$ per kg lettuce per day (low level).

Package 10 for this study included modified atmosphere storage space 14 separated from GR 18 by wall 20 formed by a seal or seam in body 12 having six small openings therein. Package 110 for this study included walls 120*a* and 120*b* formed by two seams each of which having three small openings therein, thus forming the two GRs 118*a* and 118*b*. Each reservoir (18 and 118*a,b*) contained the $ClO_2$ precursor. Packages 10 and 210 configured as described were used in study 1 as discussed herein.

Package 210 for this study incorporated a reservoir tube 218 constructed of poly(ethylene) (LDPE) for holding the $ClO_2$ precursor inserted therein, with cut lettuce was placed around tube 218. The permeability coefficient (P) of the LDPE was 66.0±1.09 kg $ClO_2$ $m/m^2*s*Pa$ (Netramai, Rubino, Auras, & Annous, 2009); $ClO_2$ gas was released from the precursor by permeation through the LDPE tube. Package 210 as described herein was used in study 2.

Chlorine Dioxide Treatment

The high level of $ClO_2$ gas release used in the studies was determined in preliminary experiments by exposing cut Romaine lettuce to different levels of $ClO_2$ gas in a closed chamber for 1 h. The 8 mg $ClO_2$/d level resulted in significant reductions in *E. coli* O157:H7 populations (data not shown) and did not cause noticeable changes in lettuce appearance. The 4 mg $ClO_2$/d release level was selected to quantify the antimicrobial effects of a lower $ClO_2$ dose.

Figure 4:
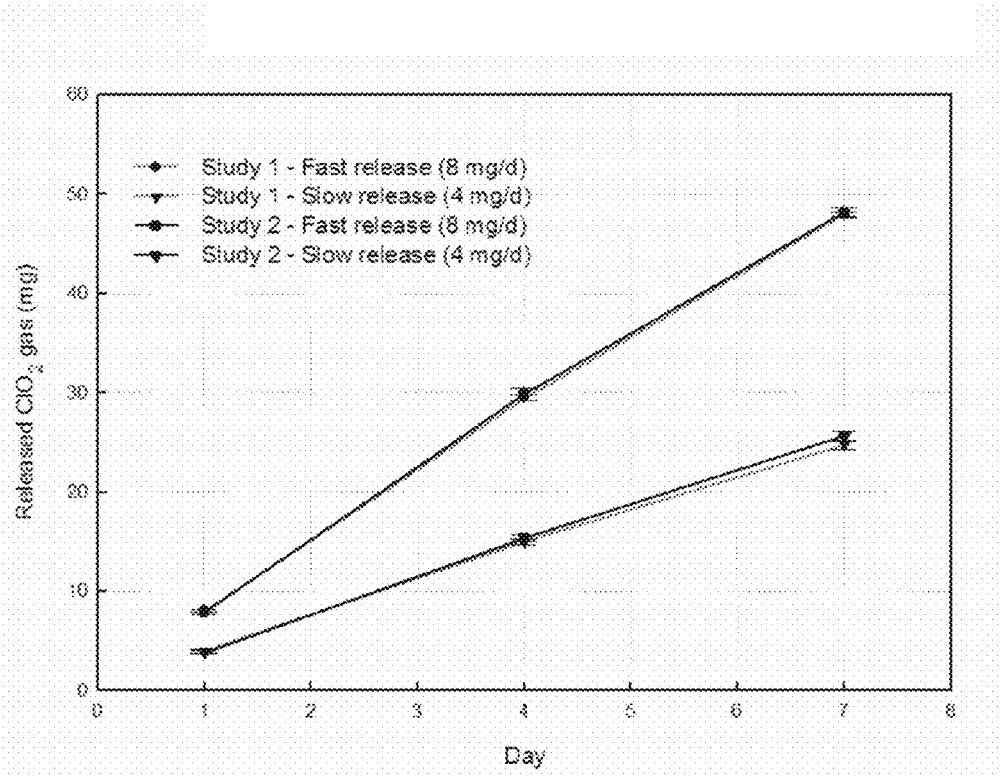
FIG. 4 is a graph illustrating profiles of gas release for fast- and slow-release chlorine dioxide precursors used in two studies, study 1 and study 2.

To generate the $ClO_2$ gas, $ClO_2$ precursor was placed in paper tubes that were inserted into the reservoirs or reservoir tube for each package. A total of 8 g of $ClO_2$ precursor was added to each package: for reservoir 18 and reservoir tube 218, this total amount was placed in one paper tube; for the reservoirs 118*a,b*, two paper tubes containing 4 g of precursor each were used in each reservoir 118*a* and 118*b*, respectively. The high or low level of $ClO_2$ gas release per kg lettuce (8 mg $ClO_2$/d or 4 mg $ClO_2$/d, respectively) was determined by the type of precursor used. The profiles of gas release were determined using a titration procedure provided by ICA TriNova and are shown in FIG. 4.

Preparation of Inoculum

*Escherichia coli* O157:H7 SEA13B88 (human feces, apple cider-associated disease outbreak), maintained at −80° C. in trypticase soy broth (TSB; Becton Dickinson, Sparks, Md.) and 10% (v/v) glycerol, was grown at 35° C. for 18-24 hours in TSB, transferred to a trypticase soy agar (TSA; Becton Dickinson) slant, and this working stock culture was stored at 4° C. for no more than 21 days. Inoculum was prepared by transferring a loopful (1 μl) of the working stock to 10 ml TSB, which was incubated at 35° C. in a shaking incubator for 6-8 hours. Following incubation, 180 μl of the culture was transferred to 1.8 L of TSB, and then incubated at 35° C. in a shaking incubator for 18-24 hours. The culture was then centrifuged (6740×g) at 4° C. for 15 min After decanting the supernatant, the resulting pellet was resuspended in sterile deionized water and centrifuged. The supernatant was decanted and the pellet was resuspended in 3.6 L of sterile deionized water. The concentration of the inoculum was determined by serially diluting the inoculum in 0.1% peptone water (PW; Becton Dickinson) and plating on TSA.

Inoculation of Lettuce

Romaine lettuce (*Lactuca sativa* L. var. *longifolia*) was purchased at a local supermarket (in Wyndmoor, Pa.) and stored at 4±2° C. for a maximum of 24 hours before use in experiments. Damaged outer leaves were removed from each head of lettuce, and the lettuce was cut into pieces approximately 4-6 $cm^2$ and immediately submerged into the *E. coli*

O157:H7 inoculum suspension for 5 min Excess liquid culture on the lettuce was removed using a conventional salad spinner purchased at a retail store for 1 min. The prepared lettuce was placed into an open container and allowed to dry at 22±2° C. for 2 h in a biosafety cabinet prior to packaging.

Packaging of *E. coli* O157:H7-Inoculated Lettuce

*E. coli* O157:H7-inoculated lettuce (283 g [about 10 oz]) was placed in each package and the appropriate paper tube(s) containing the $ClO_2$ precursor were placed in the reservoirs as described herein. The food storage spaces of the packages were sealed, photographed (day 0), and stored upright at 4±1° C. for up to 7 days. Following the 1st, 4th, or 7th day of storage, samples were photographed and visually inspected for changes in appearance and color, and then evaluated for residual microbial populations.

Microbial Enumeration

Results from preliminary experiments suggested that there was no significant difference in *E. coli* O157:H7 cell reductions on lettuce samples taken from the top or bottom of the single reservoir 18 package 10 and dual reservoir 118*a,b* package 110 designs. Thus, sampling locations used with each bag design were based on dividing the bag into lengthwise areas, substantially parallel to the gas reservoirs, and taking samples therefrom. Microbial enumeration and comparison was focused on these sampling locations.

For sampling, one 25-g sample of lettuce was removed from each location within each bag and homogenized with 75 mL Dey-Engley (DE) neutralizing broth (Becton Dickinson) for 1 min, using a stomacher blender. Undiluted DE broth from the homogenate was serially diluted in sterile neutralizing broth to the desired dilutions and then spread-plated in duplicate onto TSA. The plates were incubated at 37±0.5° C. for 2 hours (for injured cells to recover), overlaid with Sorbitol MacConkey agar (SMAC; Remel, Lenexa, Kans.), supplemented with cefixime and potassium tellurite (CT; Invitrogen, Dynal AS, Oslo, Norway), and then incubated at 37±0.5° C. for an additional 22 hours; colonies were enumerated as *E. coli* O157:H7 (Keskinen, Burke, & Annous, 2009).

Statistical Analyses

The experimental design followed a randomized complete block design, as outlined in Table 1 shown in FIG. 5, in which the experiments were repeated twice (2 blocks) and each experiment involved three replicates. The results obtained were statistically evaluated by analysis of variance (ANOVA) using the Statistical Analysis System (SAS) software (SAS Institute Inc., Cary, N.C.) at the confidence level of 95% (a=0.05) with Tukey's adjustment for comparison of means.

Results and Discussion

This work considered the packaging system as one safety component to be used in a hurdle strategy. Two consecutive studies were conducted to evaluate the impact of packaging design modifications on the efficacy of the $ClO_2$ gas. Study 1 compared the package 10 and package 110 designs in which the $ClO_2$ was released from one or two reservoirs or side chambers of the package into the modified atmosphere storage space, or for purposes of this embodiment, a food storage space for holding the lettuce. Study 2 was conducted with the 210 package, at least to evaluate the effect of minimizing the distance between the $ClO_2$ gas releasing reservoir and the lettuce.

Study 1: Efficacy of $ClO_2$ in 1-GR and 2-GR Bags

The dimensions of the reservoir were determined in packages 10 and 110 by, among other things, by taking into consideration the flexible volume, $ClO_2$ dose, $ClO_2$ chemical characteristics, and lettuce weight per bag. The openings on the bags' interior walls that formed the reservoirs were designed to distribute an equal amount of $ClO_2$ gas to the lettuce sample throughout the whole modified atmosphere storage space. The total numbers of openings in the walls of both designs were the same, but the locations of the openings in the walls were different. Gas distribution in the bags is presumed to be at least partially dependent on the reservoir location, that is, in the package 10 design the ClO2 gas enters the modified atmosphere storage space from one direction only, whereas in the package 110 design the $ClO_2$ gas enters from two directions. Unmodified packages were used as controls in the study.

A summary of the influence of package design and $ClO_2$ gas levels on reductions of the average populations of *E. coli* O157:H7 recovered from the bagged, inoculated lettuce after storage is provided in Table 2 shown in FIG. 6, wherein 1-GR refers to the package 10 design and 2-GR refers to the package 110 design. The $\log_{10}$ CFU reductions were calculated from the difference of *E. coli* O157:H7 populations recovered from the control bags and those recovered from package 10 and package 110, and represent the total reduction in *E. coli* O157:H7 populations by $ClO_2$ gas at each storage time.

For the package 10 design, increasing the $ClO_2$ gas dose (from 4 to 8 mg $ClO_2$/d) resulted in a significant increase in the average $\log_{10}$ CFU/g reductions for the packaged samples on day 1 and day 4 of storage. However, increasing the dose of $ClO_2$ gas per day by 100% did not double the reduction of the pathogen populations. For the package 110 design, increasing $ClO_2$ gas dose resulted in a significant increase in the reduction of *E. coli* O157:H7 cells only on day 1 of storage; in the package 110 design the $ClO_2$ gas level had no significant effect on population reductions after day 4 and day 7.

The reservoir locations and openings affected the antimicrobial efficacy of the $ClO_2$ gas, as indicated by the significantly greater population reductions realized in the package 110 design compared to the package 10 design at the same $ClO_2$ dose level (See for example, Table 2 of FIG. 6) at most storage times. Releasing the antimicrobial gas from both sides as in the package 110 design reduced *E. coli* O157:H7 populations on the lettuce more effectively than releasing the gas from only one side in the package 10 design, which may be due to the shorter distance that the $ClO_2$ gas has to travel to reach the target surfaces. In addition to the traveling distance for $ClO_2$ gas, another factor affecting gas distribution could be the absorption of $ClO_2$ by the lettuce. Though no data exist on the $ClO_2$ absorption behavior of lettuce, in the bagged lettuce systems studied here, the $ClO_2$ gas is being constantly released and could react and be absorbed by the lettuce, especially by pieces located adjacent to the reservoir. As a result, less $ClO_2$ gas would reach the lettuce located in the areas further away from the reservoir.

Differences in $\log_{10}$ reductions of *E. coli* O157:H7 achieved by the package 110 designs compared to the package 10 designs were more pronounced at the 4 mg $ClO_2$/d dose. At day 1, these differences were 0.12 and 0.07 $\log_{10}$ CFU/g at dose levels of 4 and 8 mg $ClO_2$/d, respectively, as shown in Table 2 of FIG. 6. This finding suggests that there was interaction between design and $ClO_2$ level (design*concentration), as supported by statistical outcomes (p=0.042).

A comparison of $\log_{10}$ CFU/g reductions between the package 10/8 mg and the package 110/4 mg treatments at 1 and 4 days of storage revealed no significant difference in population reductions, even though only half the amount of $ClO_2$ gas is released with the 4 mg/d dose. Furthermore, at 7 days of storage, a greater $\log_{10}$ CFU/g reduction was achieved with the lower amount of $ClO_2$ gas in the package 110 than with the package 10 design (with 8 mg ClO2/d).

The package design had a significant impact on improving the antimicrobial efficacy of ClO2 gas. Therefore, by reducing the traveling distance of the gas to its target surfaces, it should be possible to reduce the dose of $ClO_2$ and still deliver the equivalent $\log_{10}$ CFU/g reduction of *E. coli* O157:H7. Utilization of lower $ClO_2$ doses could also result in less appearance and texture changes to fresh food products (Ellis, et al., 2006; Gomez-Lopez, et al., 2009).

In addition to browning, which normally occurs at cut and bruised areas of fresh produce (Cantwell, Rovelo, Nie, & Rubatzky, 1998; Lopez-Galvez, Saltveit, & Cantwell, 1996) the lettuce samples exposed to $ClO_2$ gas also developed softer, watery and/or bleached tissues. Other researchers have observed similar changes in produce (Du, Fu, Li, & Xia, 2007; Han, et al., 2000). These changes were more obvious in the lettuce pieces located in areas adjacent to the reservoir sections. Lettuce samples in package 10 designs with the 8 mg $ClO_2$/d dose showed more changes in appearance than lettuce obtained from package 110 designs with the 4 mg $ClO_2$/d dose, and these changes became more pronounced at day 4 and day 7.

Sampling from specific locations generally parallel to the reservoir(s) within the bags was carried out to further evaluate how proximity of the lettuce to the antimicrobial gas source impacts the product throughout the package, as determined by $\log_{10}$ CFU/g reductions of *E. coli* O157:H7.

Regardless of the level of $ClO_2$ gas used, the reductions of *E. coli* O157:H7 on the lettuce sampled from locations adjacent to the reservoir were significantly greater than on those samples collected further away from the reservoirs, as shown in Table 3 of FIG. 7. For package 10, reductions of *E. coli* O157:H7 on the samples taken from the middle area (location 2) and the area most distant from the reservoir (location 3) were statistically equal. For package 10, location 1 is the area adjacent to the reservoir. For package 110 location 1 is the area adjacent to the reservoirs and location 2 is the middle area of the package. For package 210, location 1 is the middle area closest to the reservoir tube and location 2 is the side areas most distant from the middle area. These trends were observed at all storage times. These results confirmed that $ClO_2$ gas was most effective in the areas close to the reservoir. Furthermore, the softer and watery cut leaves could partially block gas flow to other areas of the bag, and further reduce accessibility to the target surfaces, resulting in low kills in the areas distant from the gas release (Du, et al., 2002; Ellis, et al., 2006).

Study 2: Efficacy of $ClO_2$ Gas in Package 210 Designs (Aka "Mid-GR" Bags)

The LDPE tube placed in the center of the package 210 bag has a very low barrier to $ClO_2$ gas. The permeability of the LDPE polymer allows the gas to be readily released and available for decontamination within the package chamber. For this study, $ClO_2$ gas was released through the entire surface of the LDPE tube, whereas in the previous study the $ClO_2$ gas was mainly delivered through the six openings located along the interior seals.

Reductions of the average populations of *E. coli* O157:H7 recovered from the package 210 bagged lettuce after storage are shown in Table 4 of FIG. 8. With this design, increasing the $ClO_2$ gas in the package headspace significantly increased the $\log_{10}$ CFU/g reductions of *E. coli* O157:H7. This dose effect with $ClO_2$ gas has been reported previously in green peppers and lettuce (Han, et al., 2000; Lee, Costello, & Kang, 2004). As demonstrated in study 1, reductions in *E. coli* O157:H7 populations on cut lettuce sampled from location 1 (adjacent to the reservoir) were significantly greater than from the other locations, as shown in Table 5 of FIG. 9. Changes in appearance, including bleached and watery tissues, were more noticeable from lettuce in the bags with the higher ClO2 dose, and these changes were most apparent in the lettuce pieces next to the reservoir.

Comparison of 1-GR, 2-GR and Mid-GR Bag Designs

At the gas dose of 4 mg $ClO_2$/d the package 110 and 210 designs provided similar levels of microbial inactivation, even though the gas release areas of the two designs were not equal. This finding could be attributed to the reactive nature of the $ClO_2$ gas. On the other hand, at the gas dose of 8 mg $ClO_2$/d, comparisons of $\log_{10}$ CFU/g reductions between lettuce samples showed that the efficacy of the gas was greater in the package 210 than in the package 110, likely as a result of improved gas distribution. *E. coli* O157:H7 population reductions were greater in package 110 than in package 210 by 0.61, 0.37, and 0.27 $\log_{10}$ CFU/g on day 1, 4, and 7, respectively. However, at this $ClO_2$ dose the appearance of the lettuce was compromised.

Increasing the gas release area from six small openings to the entire surface of a LDPE tube was likely the main factor in improving gas distribution in the package 210 design compared to the package 110 design. Also, a center position for the GR may have contributed to better gas distribution compared to the side positions in package 110 design. Given that the package 110 design showed comparable average $\log_{10}$ CFU/g reductions at both gas doses (Table 2), it was likely that soft and watery lettuce pieces, adjacent to the reservoir openings, partly blocked the flow of $ClO_2$ gas and affected gas distribution, especially in the 8 mg $ClO_2$/d treatment. This problem could lessen when the gas was distributed through the entire tube surface of package 210.

At the testing conditions evaluated, utilization of $ClO_2$ as an antimicrobial gas in the packages provided only up to $1.24 \pm 0.09$ $\log_{10}$ CFU/g reductions of *E. coli* O157:H7 (package 210 with 8 mg $ClO_2$/d, see Table 4). Although the average reductions represent the average microbial inactivation for a particular bag design and $ClO_2$ level, a closer examination of the inactivation at specific locations in the bags indicated that up to 2 $\log_{10}$ CFU/g reductions could be achieved at the areas adjacent to the gas release areas.

Thus, it is believed that the interior characteristics of the flexible bag, i.e., the location and size of the gas releasing area, at least partially influenced the antimicrobial effects of $ClO_2$ on *E. coli* O157:H7 inoculated on Romaine lettuce. By minimizing the travel distance between the $ClO_2$ gas and the target surface, the $ClO_2$ gas was more effective with the package 110 and package 210 designs than with the package 10 design. Maximizing the gas releasing surface area also resulted in increased reductions of the pathogen populations. These findings are of significant interest, since antimicrobial gases are typically introduced in packaging either by modifying the headspace or using sachets.

The present study also suggested that package design optimization can result in applying a smaller dose of $ClO_2$ gas to achieve the same level of reduction of *E. coli* O157:H7 populations. The delivery of $ClO_2$ gas within a packaging system could also be adjusted and regulated to suit specific product requirements by (1) selecting a polymer film with a different permeability, or (2) by changing the location or number of openings along the seal of a reservoir.

Although exemplary aspects and embodiments of the invention have been described with a full set of features, it is to be understood that the disclosed systems and methods of use and manufacture may be practiced successfully without the incorporation of each of those features. The foregoing described embodiments of the invention and accompanying materials are provided as illustrations and descriptions. They are not intended to limit the invention to the precise forms described herein.

In particular, it is contemplated that a functional implementation of the invention described herein and in the accompanying materials may be constructed of varying materials and different packaging arrangements. For example, it should be readily apparent that a package and agent releasing body of the invention may be formed in a variety of sizes and shapes, with additional reservoirs placed in various locations, such as the corners of the package, or along the periphery of a side thereof. More than one modified atmosphere storage space may also be used in a package of the invention, such as a package design with two modified atmosphere storage spaces separated by a central reservoir space. Packages may be configured to hold a variety of products therein, such as surgical tools, medicines, or other items which would benefit advantageously from storage in a modified atmosphere space as described herein. Thus, variations and additional embodiments are possible in light of above teachings, and it is not intended that this description should limit the scope of invention. It is to be understood that modifications and variations may be utilized without departure from the spirit and scope of the invention and method disclosed herein, as those skilled in the art will readily understand, and such modifications and variations are therefore considered to be within the purview and scope of the invention as set for the by the claims and equivalents thereto.

The invention claimed is:

1. A package providing a storage space with features capable of affecting atmospheric conditions therein, comprising:

a package body having a plurality of sidewalls, the sidewalls defining a first storage space and at least one second storage space adjacent thereto, wherein at least a portion of the at least one of the plurality of sidewalls is shared between the first storage space and at least one of the second storage spaces, the at least one second storage space providing a reservoir for containing an antimicrobial agent;

the antimicrobial agent disposed within the reservoir and including a precursor to chlorine dioxide gas, wherein a portion of the at least one of the plurality of sidewalls is configured to allow for the delivery of the chlorine dioxide gas from the at least one second storage space into the first storage space; and at least one releasing tab on the portion of the at least one of the plurality of sidewalls between the first storage space and at least one second storage space, the releasing tab configured to regulate the delivery of the chlorine dioxide gas from the at least one second storage space into the first storage space.

2. A package as recited in claim 1, wherein the package body has a first end and an opposing second end and the at least one second storage space is positioned at the first end of the package body.

3. A package as recited in claim 1, wherein the at least one second storage space is positioned in the middle area of the package body.

4. A package as recited in claim 1, wherein there is at least two second storage spaces positioned at distal ends of the package body.

5. A package as recited in claim 1, wherein the portion of the sidewall which further defines the first storage space is constructed of a material which is permeable to chlorine dioxide gas.

6. A package as recited in claim 1, wherein the portion of the at least one of the plurality of sidewalls between the first storage space and the at least one second storage space is perforated.

7. A package as recited in claim 1, wherein the chlorine dioxide gas precursor is configured to deliver chlorine dioxide gas in a dosage of less than 10 milligrams per day.

8. A package as recited in claim 1, wherein the package body is substantially formed of a plastic material.

9. A package as recited in claim 1, wherein the at least one second storage space is substantially tubular in shape.

10. A package as recited in claim 4, wherein the chlorine gas precursor is configured to deliver chlorine gas in a dosage which is less than 10 milligrams per day from the at least two distally positioned second storage spaces.

11. A package providing a storage space with features capable of affecting atmospheric conditions therein, comprising:

a package body having a plurality of sidewalls, the sidewalls defining:

a first storage space;

at least one second storage space adjacent to the first storage space, wherein a portion of the at least one of the plurality of sidewalls is shared by the first storage space and the at least one second storage space, the at least one second storage space providing a reservoir for an antimicrobial agent therein;

an antimicrobial agent within the at least one second storage space, the antimicrobial agent configured to move from the at least one second storage space into the first storage space through the portion of at least one of the plurality of sidewalls; and a releasing tab on the portion of the at least one of the plurality of sidewalls between the first storage space and the at least one second storage space, the releasing tab configured to regulate the delivery of the antimicrobial agent from the at least one second storage space into the first storage space.

12. The package of claim 11, wherein the package body includes at least two second storage spaces, each second storage space having a portion of at least one of the plurality of sidewalls shared with the first storage space.

13. The package of claim 12, wherein the antimicrobial agent is the same within each second storage space.

14. The package of claim 12, wherein the antimicrobial agent is different within each second storage space.

* * * * *